United States Patent [19]

Yokoi et al.

[11] Patent Number: 4,640,809

[45] Date of Patent: Feb. 3, 1987

[54] METHOD FOR MANUFACTURING A CERAMIC HEATER

[75] Inventors: Shinichi Yokoi; Tsuneo Ito, both of Aichi, Japan

[73] Assignee: NGK Spark Plug Co., Ltd., Nagoya, Japan

[21] Appl. No.: 606,606

[22] Filed: May 3, 1984

Related U.S. Application Data

[62] Division of Ser. No. 549,327, Nov. 7, 1983, Pat. No. 4,502,430.

[30] Foreign Application Priority Data

Nov. 8, 1982 [JP] Japan ..... 194767
Nov. 8, 1982 [JP] Japan ..... 194768

[51] Int. Cl.[4] ..... B24B 11/00

[52] U.S. Cl. ..... 264/61; 264/67; 264/325

[58] Field of Search ..... 264/325, 61, 67

[56] References Cited

U.S. PATENT DOCUMENTS

| | | | |
|---|---|---|---|
| 2,030,937 | 2/1936 | Reichmann | 123/145 |
| 3,017,541 | 10/1957 | Lawser | 361/266 |
| 3,373,724 | 3/1968 | Papst | 123/32 |
| 3,914,500 | 10/1975 | Brennan et al. | 161/60 |
| 4,035,613 | 7/1977 | Sagawa et al. | 219/552 |
| 4,108,652 | 8/1978 | Ogawa | 264/325 |
| 4,153,666 | 5/1979 | Alliegro | 264/325 |
| 4,192,989 | 3/1980 | Jeromin | 219/216 |
| 4,314,961 | 2/1982 | Steinkamp | 264/325 |
| 4,357,526 | 11/1982 | Yamamoto et al. | 219/544 |
| 4,460,423 | 7/1984 | Bosnia | 264/261 |

FOREIGN PATENT DOCUMENTS

| | | |
|---|---|---|
| 51-42142 | 9/1976 | Japan . |
| 54-34145 | 3/1979 | Japan . |

*Primary Examiner*—James Derrington
*Attorney, Agent, or Firm*—Finnegan, Henderson, Farabow, Garrett & Dunner

[57] ABSTRACT

A method of making a ceramic heater by preparing a heating coil having a circular cross-section and bending it into a U-shaped form. Lead wires are connected to the ends of the U-shaped coil; the coil is embedded in a ceramic powder to form a preform having a substantially rectangular cross-section. The preform is compacted under heat to reduce the length of the rectangular cross-section and deform the coil embedded therein into a coil having an oval cross-section. The preform is sintered to form a ceramic product having a substantially circular cross-section and then ground to form a product having a circular cross-section.

5 Claims, 19 Drawing Figures

METHOD FOR MANUFACTURING A CERAMIC HEATER

CROSS-REFERENCE TO RELATED APPLICATION

This is a divisional application of U.S. Ser. No. 549,327, filed Nov. 7, 1983 now U.S. Pat. No. 4,502,430.

BACKGROUND OF THE INVENTION

The present invention relates to a ceramic heater which can be used in the fabrication of a glow plug for a diesel engine, a heater for the air drawn into a diesel engine, an igniter for a gas or oil burner, a soldering bit, a heater for an electronic range or oven, and the like, and also to a method for manufacturing the same.

FIGS. 1 and 2 show a ceramic heater 3 which includes a heating coil 2' embedded in a ceramic insulator 1 having a circular cross section. If the heating coil had a circular cross section and were concentric with the insulator 1, as shown at 2 by broken lines in FIG. 2, the heater would provide a uniform temperature distribution in all directions radially of the insulator. Although the coil is formed with a circular cross section, it is difficult to ensure that it retains its circular shape, since during manufacture pressure is applied toward the axis of the coil in two diametrically opposed directions (as shown by arrows in FIG. 2) to compact a ceramic powder surrounding the coil in a mold by a hot press to form the ceramic insulator by sintering. The pressure so applied necessarily deforms the coil into an oval shape in cross section, as shown at 2' by solid lines in FIG. 2. The ceramic insulator 1 has a peripheral surface which is not uniformly spaced apart from the coil 2'. A temperature difference thus develops in the ceramic insulator and renders it liable to crack. No uniform temperature distribution can be obtained around the surface of the heater 3.

FIGS. 3 and 4 show a ceramic glow plug G adapted for use in a diesel engine for preheating the combustion cylinder or auxiliary combustion chamber thereof. The glow plug G includes a ceramic insulator 1 formed from heat conductive material and having a specially shaped cross section which is similar to a rectangle, as shown in FIG. 4. A U-shaped heating coil 2 is embedded in the insulator 1 and lies in a plane which is generally in parallel to the longersides of the cross section of the insulator 1. When the glow plug G is installed in the combustion chamber of an engine as shown in FIG. 5, the heater 3 has its cross-sectional configuration disposed relative to the plane of FIG. 5, for example, as shown in FIG. 6 or in FIG. 7.

If the heater 3 faces in the wrong direction relative to a jet of fuel 15 from a nozzle 14, it will fail to preheat the fuel 15 properly, resulting particularly in the disadvantage that the engine cannot be easily started in cold temperature. This problem can be overcome if the heating coil is provided with a circular cross section, as shown at 16 in FIG. 8, and embedded concentrically in a ceramic insulator 17 having a circular cross section, as shown in FIG. 8. The difficulty in positioning the coil in a circular cross-sectional shape, however, has already been pointed out with reference to FIG. 2, and thus the coil is necessarily deformed into an oval shape as shown by solid lines at 16' in FIG. 8. The disadvantages of the ovally deformed coil have already been pointed out with reference to FIG. 2.

SUMMARY OF THE INVENTION

Accordingly, it is an object of this invention to provide a ceramic heater having a circular cross section which provides a uniform temperature distribution, has an excellent heating property, and is easy to install.

Fulfilling this object, the ceramic heater of the invention is particularly featured by a heating coil having an oval cross section and which is bent in a U-shape. The coil is embedded in a ceramic insulator in a specific dimensional relationship thereto. The temperature difference on the surface is thereby reduced to a minimum, and therefore no cracking forms in the ceramic insulator. The heater is easy to install, for example, in the combustion chamber of a diesel engine to achieve effective preheating of fuel.

It is another object of this invention to provide a method for manufacturing a ceramic heater having a circular cross section which provides a uniform temperature distribution, has an excellent heating property and is easy to install. A heating coil having a circular cross section and bent in a U shape is embedded in a ceramic powder which is prepared in a preform having a rectangular cross section. The ceramic powder so prepared is compacted in a hot press in such a manner that the longer sides of its cross section are shortened to about half the original length. The ceramic powder is sintered to form a sintered ceramic product having a substantially circular cross section, and in which the coil is deformed into an appropriately sized oval shape. The sintered product is then ground on its outer peripheral surface to provide a ceramic heater having a circular cross section and in which a cylinder defined by the U-shaped coil and the outside diameter of the ceramic insulator have an appropriate ratio.

DESCRIPTION OF THE PREFERRED EMBODIMENTS

Figure 9:
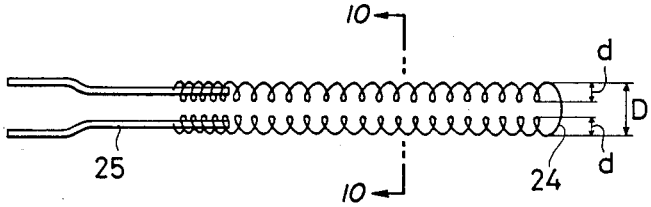
FIG. 9 is a side elevational view of a heating coil having a circular cross section and lead wires in a ceramic heater constructed in accordance with the invention.
Figure 10:
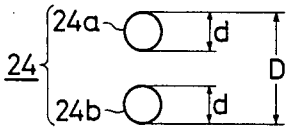
FIG. 10 is an enlarged sectional view taken along a line 10—10 in FIG. 9.

A method of manufacturing a ceramic heater of the invention having a circular cross section with an outside diameter of 4.0 mm will now be described by way of example. FIG. 9 shows a heating coil 24 having a circular cross section and bent in a U shape. The coil 24 is prepared by winding a wire of resistance heating material, such as tungsten (W) or molybdenum (Mo), having a diameter of 0.2 mm, spirally into a coil having an outside diameter d of 1.0 mm, and bending it into a U-shaped heating element having a pair of parallel legs 24*a* and 24*b*, as indicated in FIG. 10. The coil 24 has a width D of 3.0 mm, which is the distance between the outer edges of the legs 24*a* and 24*b*. The lead wires 25, which will later be connected to a positive electrode and a ground electrode, respectively, are connected to the ends of the legs 24*a* and 24*b*.

Figure 11:
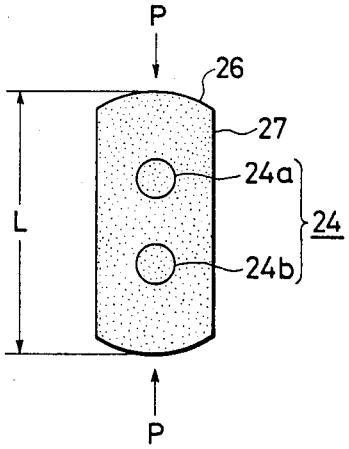
FIG. 11 is a cross-sectional view of a preform prepared in accordance with the invention.

The coil 24 is placed in a preforming mold having a substantially rectangular cross section, of which the length is indicated by L in FIG. 11. A ceramic powder 26, composed mainly of silicon nitride ($Si_3N_4$), is compacted in the mold at a pressure of 1,500 to 2,000 kg/cm$^2$ to prepare a preform 27 having a substantially rectangular cross section. The preform 27 is compressed along its cross-sectional length L by pressure applied in two opposite directions, as indicated by arrows P in FIG. 11, in a hot press (not shown) so that the length L is reduced to about L/2, as indicated in FIG. 12, whereupon the ceramic powder is sintered to form a sintered product 28.

Figure 6:
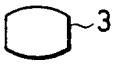
FIG. 6 (PRIOR ART)
FIGS. 6 and 7 show different cross-sectional positions of the conventional plug in the combustion chamber.
Figure 7:
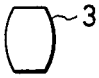
FIG. 7 (PRIOR ART)
Figure 12:
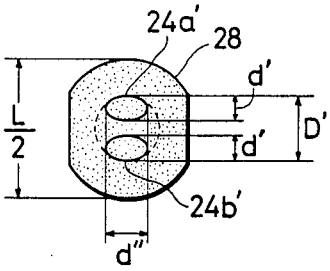
FIG. 12 is a cross-sectional view of a sintered product formed in accordance with the invention.

At that time, the coil 24 embedded in the sintered ceramic product is deformed into a shape having an oval cross section, as shown at 24*a*′ and 24*b*′ in FIG. 12. The oval cross section of each of the legs 24*a*′ and 24*b*′ of the coil 24 has a short diameter d′ of 0.8 mm and a long diameter d″ of 1.3 mm, which have an approximate ratio of 62:100. The legs 24*a*′ and 24*b*′ define a cylinder, shown by a broken line in FIG. 6B, having a diameter D′ of about 2.0 mm.

Figure 13:
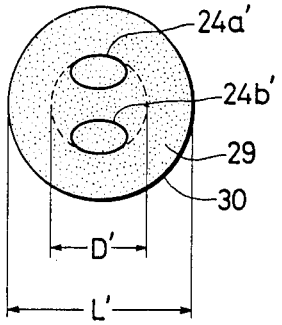
FIG. 13 is a cross-sectional view of a ceramic heater embodying the invention.

The sintered product 28 is ground on its outer peripheral surface to form a ceramic heater 30 having a circular cross section, as shown in FIG. 13, composed of a ceramic insulator 29 having an outside diameter L′ of 4.0 mm. The diameter D′ of cylinder defined by the legs 24*a*′ and 24*b*′ of the coil and the outside diameter L′ of the ceramic insulator 29 have an approximate ratio of 50:100.

A preferred ratio of the short diameter d′ to the long diameter d″ of the coil (which is oval in cross section), and the preferred ratio of the diameter D′ to the outside diameter L′ of the ceramic insulator have been experimentally determined by the inventors of this invention. Particularly, the preferred short and long diameters d′ and d″ of the coil are expressed by the following equation:

$$(d'/d'')\times 100\ (\%)=50 \text{ to } 70\ (\%).$$

If the short diameter d′ is smaller than 50% or larger than 70% of the long diameter d″, temperature differences develop in the ceramic insulator and around its surface when the heater is activated. The thermal strain created by the non-uniformity in temperature distribution tends to cause cracking of the ceramic insulator. The nonuniformity in the surface temperature of the heater is also likely to have an adverse effect on the starting characteristics of a diesel engine in which it is employed.

The preferred ratio of the diameter D′ to the insulator diameter L′ are expressed by the following equation:

$$(D'/L')\times 100\ (\%)=35 \text{ to } 70\ (\%).$$

If the diameter D′ is smaller than 35% of the insulator diameter L′, the coil has too low a heating efficiency, and thus a large temperature difference develops between the coil and the insulator surface. The resulting thermal strain is likely to cause cracking of the ceramic material. If the diameter D′ is larger than 70%, a sufficiently large temperature difference develops between the center of the ceramic insulator and its surface that the ceramic material is likely to crack, although the heating efficiency of the coil may be improved.

Figure 1:
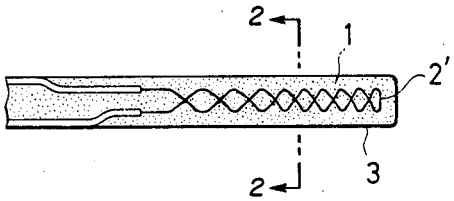
FIG. 1 (PRIOR ART)
FIG. 1 is a longitudinal sectional view of a conventional ceramic heater.
Figure 2:
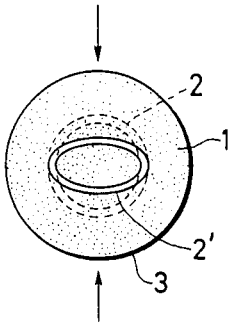
FIG. 2 (PRIOR ART)
FIG. 2 is an enlarged sectional view taken along a line 2—2 in FIG. 1.
Figure 3:
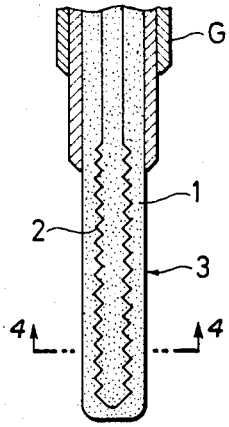
FIG. 3 (PRIOR ART)
FIG. 3 is a longitudinal sectional view of a conventional ceramic glow plug.
Figure 5:
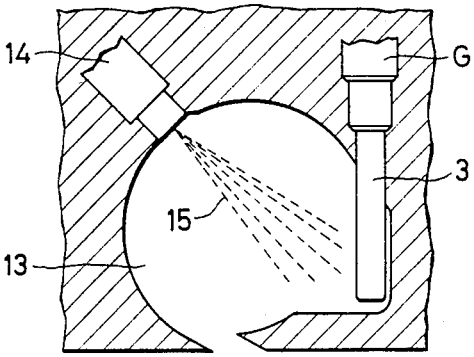
FIG. 5 (PRIOR ART)
FIG. 5 is a vertical sectional view of a combustion chamber in which a conventional ceramic glow plug is installed.
Figure 4:
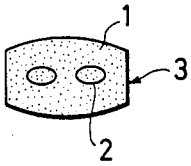
FIG. 4 (PRIOR ART)
FIG. 4 is an enlarged sectional view taken along a line 4—4 in FIG. 3.
Figure 14:
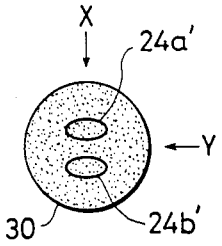
FIGS. 14 and 15 are cross-sectional view of ceramic heaters showing points of measurement of the surface temperature.
Figure 15:
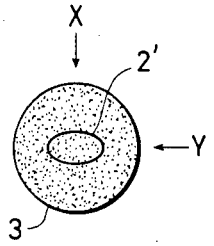
FIG. 15 (PRIOR ART)

The ceramic heater 30 of the invention and the conventional ceramic heater of the type shown at 3 in FIGS. 1 and 2 and having the same outside diameter as the ceramic heater of this invention were compared with each other with respect to the distribution of surface temperature. A DC voltage of 10.5 V was applied to each heater, and after six seconds its surface temperature was measured at two points indicated by arrows X and Y in FIGS. 14 and 15. The results indicated a by far smaller temperature difference and, therefore, a by far better temperature distribution in the ceramic heater of the invention. In the heater of the invention shown in FIG. 14, the surface temperature was 928° C. at X and 925° C. at Y, a difference of only 3° C. therebetween. In contrast the conventional heater shown in FIG. 15 showed a difference of 13° C. between X and Y, 916° C. at X and 903° C. at Y.

Figure 16:
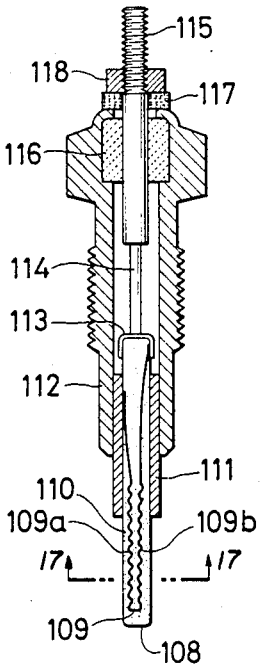
FIG. 16 is a longitudinal sectional view of a ceramic glow plug embodying the invention.
Figure 17:
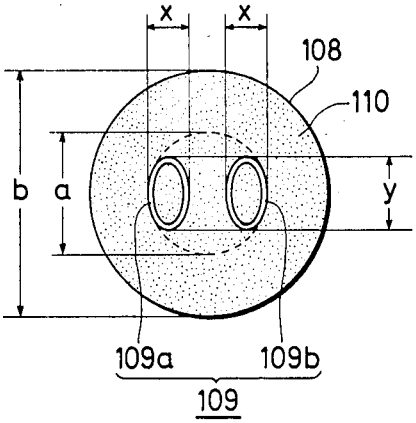
FIG. 17 is an enlarged sectional view taken along a line 17—17 in FIG. 16.

A ceramic glow plug embodying the invention is shown in FIGS. 16 and 17. A heater 108 is composed of a heating coil 109 formed from a wire of resistance heating material such as tungsten (W) or molybdenum (Mo), having an oval cross section and bent in a U shape. The coil 109 is embedded in a ceramic insulator 110 composed mainly, for example, of silicon nitride ($Si_3N_4$) and having a circular cross section. The coil 109 has a pair of parallel legs 109*a* and 109*b*. The diameter a of a cylinder defined by the legs 109*a* and 109*b*, as shown by a broken line in FIG. 9B, and the outside diameter b of the ceramic insulator 110 have a ratio of 35:100 to 70:100. If the diameter of the cylinder is smaller than 35% of the insulator diameter, the coil will have an inferior heating capacity, and a large temperature difference develops between the coil and the insulator surface creating thermal stress which is likely to result in cracking of the ceramic insulator. If the cylinder diameter is larger than 70% of the insulator diameter, a large temperature difference develops, rendering the ceramic insulator liable to crack, although the heating capacity of the coil may be improved. The short and long diameters x and y (FIG. 17) of each of the legs 109*a* and 109*b* of the coil have a ratio of 50:100 to 70:100. If the ratio does not fall within this range, a similar nonuniformity in temperature distribution renders the ceramic insulator 110 liable to crack.

One leg 109*a* of the coil 109 has an end brazed to a metal sleeve 111, which is in turn brazed to a metal fixture 112 to define a ground electrode. The other leg 109*b* is brazed to a metal cap 113 at an end of the ceramic insulator 110. The cap 113 is connected to a shaft 115 by a connecting wire 114. The fixture 112 has an upper end sealed about the shaft 115, and an insulator 116 is secured between the fixture 112 and the shaft 115. A nut 118 is screwed onto a threaded portion of the shaft 115, and an insulating ring 117 is disposed between the upper end of the fixture 112 and the nut 118. The shaft 115 defines a positive electrode and forms a path for electric current.

The heater for the ceramic glow plug of the invention may be manufactured, for example, in a manner as will hereinafter be set forth:

(1) A tungsten wire having a diameter of 0.2 mm is wound into a coil which is circular in cross section and has a diameter of 1.0 mm. The coil is folded into a U shape defined by a pair of parallel legs having an overall width of 3.0 mm, which is the distance between the outer edges of the legs.

(2) Lead wires, each having a diameter of 0.6 mm, which will later be connected to a positive electrode and a ground electrode, respectively, are connected to the ends of the coil, that is, to its U-shaped legs.

(3) The coil is placed in a mold having a substantially rectangular cross section, and a ceramic powder composed mainly of silicon nitride ($Si_3N_4$) is introduced into the mold to prepare a preform into which the coil is embedded.

(4) The preform is compacted in a hot press so that the cross-sectional length of the preform is reduced to half the original length, whereby a sintered product having a substantially circular cross section is obtained.

(5) Finally, the sintered product is ground into a product which is circular in cross section and has an outside diameter of 4.0 mm.

Referring to FIG. 17, the coil in the heater formed as hereinabove described has a short diameter x of 0.8 mm and a long diameter y of 1.3 mm, which have a ratio of 62:100. The cylinder defined by the coil has a diameter a of 2.0 mm, and the ceramic insulator has an outside diameter b of 4.0 mm. Thus, the diameters a and b have a ratio of 50:100.

Figure 8:
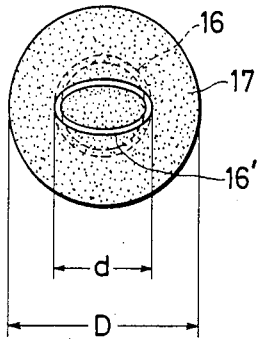
FIG. 8 is a cross-sectional view showing another heater construction.
Figure 18:
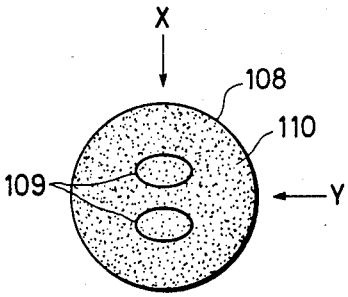
FIG. 18 is a cross-sectional view showing points at which the temperature was measured for checking the temperature distribution on the surface of the ceramic heater shown in FIGS. 16 and 17.
Figure 19:
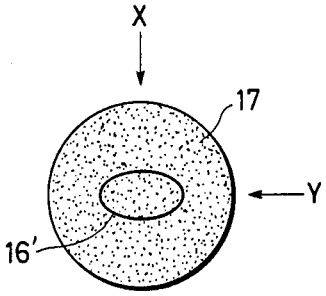
FIG. 19 (PRIOR ART)
FIG. 19 is a view similar to FIG. 18, but showing a different heater.

The ceramic glow plug of the invention including a heater having an outside diameter b of 4.0 mm as hereinabove described and a glow plug including a heater of the type shown in FIG. 8 and having an outside diameter D of 4.0 mm and a coil long diameter d of 2.0 mm were compared with each other with respect to the distribution of heater surface temperature. A DC voltage of 10.5 V was applied to each plug, and after six seconds, the surface temperature was measured at two points as shown by arrows X and Y in FIGS. 18 and 19. In the glow plug of the invention shown in FIG. 18, the surface temperature was 928° C. at X and 925° C. at Y, that is, a difference of only 3° C. therebetween. In the conventional glow plug shown in FIG. 19, however, the surface temperature showed a difference of 13° C. between X and Y, 916° C. at X and 903° C. at Y. These results demonstrate a far better uniformity in the distribution of temperature around the surface of the heater in the glow plug of the invention.

As is evident from the foregoing description, the invention provides a ceramic glow plug which overcomes the drawbacks of the prior art, and which provides a highly uniform temperature distribution on the heater surface, which prevents cracking of the ceramic material. Moreover, effective heating is achieved in whichever position the plug is mounted relative to the direction of fuel injection. These advantages of the invention are attributable to the specific dimensional relationship between the heating coil and the ceramic insulator and the specifically defined oval cross section of the coil, as hereinabove described.

We claim:

1. A method of manufacturing an elongated ceramic heater, comprising the steps of:

forming an elongated U-shaped heating coil by bending an elongated helical coil having a circular cross section into a U-shaped form having two generally parallel helical coil portions and a bend at one end of said U;

embedding said U-shaped coil in a ceramic powder;

forming said powder into a preform having a generally rectangular cross section with the bend in said U-shaped coil adjacent one end of said preform;

compacting and sintering said preform to reduce the longer cross-sectional dimension of said rectangle thereby deforming each of said helical coil portions of said U-shaped coil into an oval cross section, wherein each of said deformed coils has an oval cross section, wherein planes passing through the long cross-sectional dimension of each of said ovals would be substantially parallel to one another and a plane passing through the short cross-sectional dimension of each said ovals would be substantially coplanar, said compacted and sintered article having a substantially circular cross section; and grinding the outer periphery of said compacted and sintered article to form a product having a circular cross section.

2. The method of claim 1, including the step of connecting lead wires to ends of the U-shaped coil.

3. The method of claim 1, wherein the step of compacting and sintering said preform reduces the longer cross-sectional dimension of said rectangle by about one-half.

4. The method of claim 1, wherein the oval cross sections of said deformed coils have a short diameter and a long diameter, which have a ratio of 50:100 to 70:100.

5. The method of claim 1, wherein the diameter of a cylinder defined by the outer surfaces of said U-shaped coil after compaction and sintering and the outside diameter of said ground product have a ratio of 35:100 to 70:100.

* * * * *